United States Patent [19]

Spitzer

[11] 3,947,032

[45] Mar. 30, 1976

[54] TIP CAT APPARATUS INCLUDING TARGET AREAS

[76] Inventor: Henry W. Spitzer, Star Rte. 36-91-A, Havre, Mont. 59501

[22] Filed: Oct. 16, 1974

[21] Appl. No.: 515,251

[52] U.S. Cl. ..... 273/95 F; 273/95 H; 273/106 R

[51] Int. Cl.[2] ..... A63B 71/00

[58] Field of Search..... 273/95 R, 95 E, 95 F, 95 H, 273/102 R, 102 S, 67 R, 29 BE, 29 BF

[56] References Cited

UNITED STATES PATENTS

| | | | |
|---|---|---|---|
| 697,457 | 4/1961 | Doering | 273/95 F |
| 1,903,539 | 4/1933 | Warner | 273/95 F |
| 2,069,487 | 2/1937 | Riper | 273/95 E |
| 3,009,700 | 11/1961 | Dolega | 273/95 H |
| 3,091,461 | 5/1963 | Taylor | 273/95 F |
| 3,536,327 | 10/1970 | Kaehne | 273/95 R |
| 3,543,715 | 12/1970 | Hill | 273/67 R |
| 3,774,911 | 11/1973 | Benfield | 273/102 S |
| 3,871,651 | 3/1975 | Garcia | 273/95 F |

FOREIGN PATENTS OR APPLICATIONS

| | | | |
|---|---|---|---|
| 28,556 | 10/1908 | United Kingdom | 273/29 BE |
| 328,894 | 5/1930 | United Kingdom | 273/95 F |

*Primary Examiner*—Anton O. Oechsle
*Assistant Examiner*—Marvin Siskind
*Attorney, Agent, or Firm*—Clarence A. O'Brien; Harvey B. Jacobson

[57] ABSTRACT

A recreational apparatus having plural nets, and plural scoring areas in front of each net, is provided for use on a lawn area as small as several feet in width and approximately 40 feet in length. My "Flipper Stix" game includes a recessed and stepped starting table for receiving one of the sticks, and an elongated flipper having a handgrip portion and a flattened portion at opposite ends. Suitable clamping, staking, and tensioning apparatus are provided for sideline ropes and the nets.

4 Claims, 7 Drawing Figures

SCORING AREA
SCORING AREA
SCORING AREA
24-24
SS
22
20
18
22-22
28-28
16
14
LS
20-20
44
42
11
12
34
36
38
32-32
40

Fig. 2
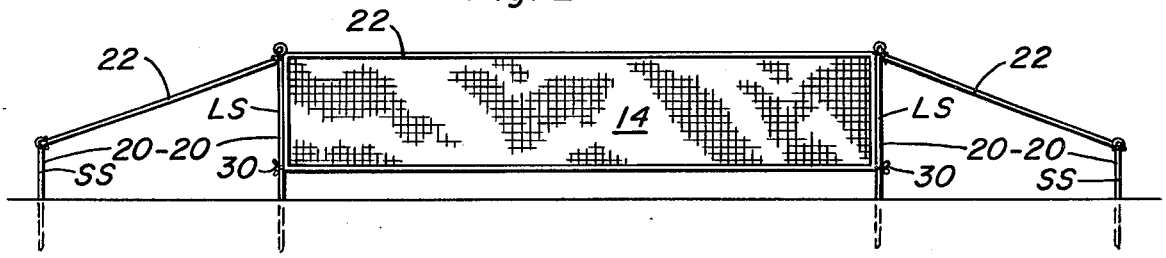
Fig. 3
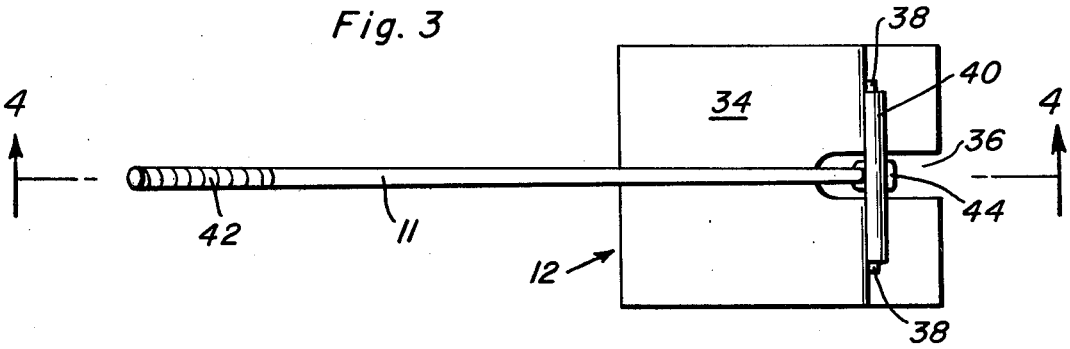
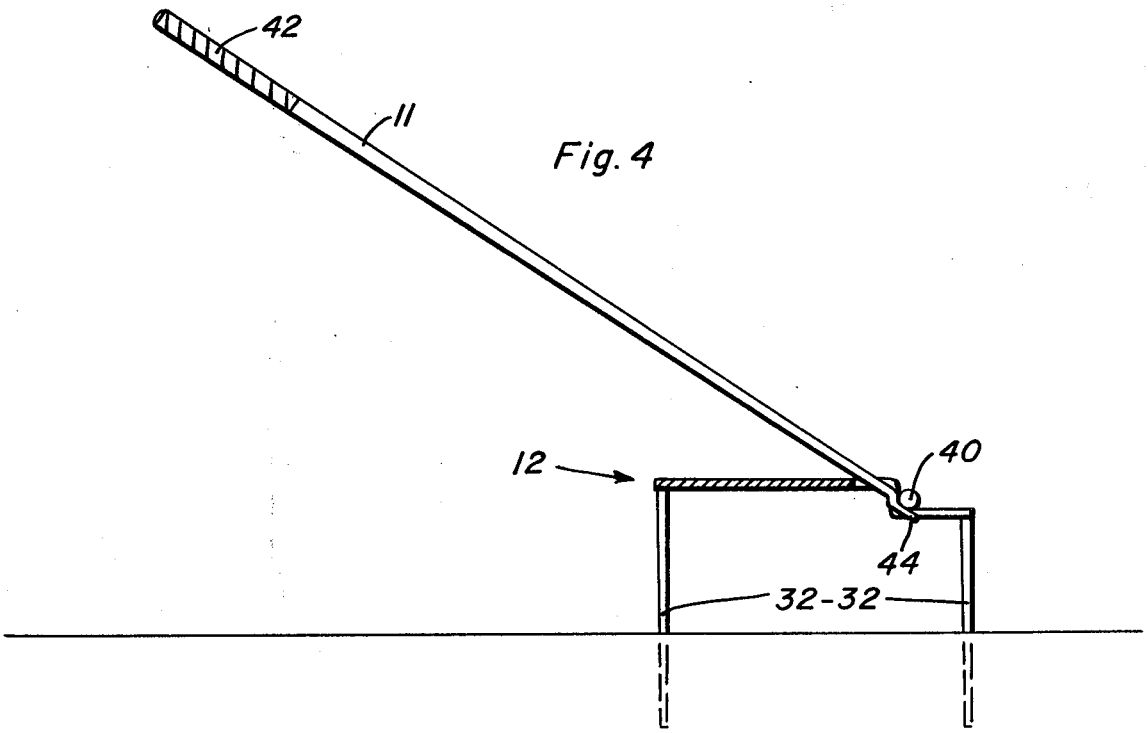
Fig. 4

TIP CAT APPARATUS INCLUDING TARGET AREAS

BACKGROUND OF THE INVENTION

The following U.S. patents are believed to be indicative of the type of prior art available in the recreational field that are directed toward similar manifestations. The Smither U.S. Pat. No. 1,128,194, issued Feb. 9, 1915 is directed to a bat, "whirl", and goal or target combination; the Bertley U.S. Pat. No. 2,802,667, issued Aug. 13, 1957 being directed toward a baseball-type game having "catching" nets; the Anderson U.S. Pat. No. 2,964,321, issued Dec. 13, 1960, disclosing a trap-cage for both projecting and receiving a ball; the Glass and Henry U.S. Pat. Nos. 3,774,912, issued Nov. 27, 1973 and 3,817,525, issued June 18, 1974, respectively, patents disclosing various notched and slotted arrangements for propelling and receiving projectiles.

SUMMARY OF THE INVENTION

Among the objects and advantages of my invention are the following:

1. To provide a backyard or lawn type game which any number of people can play after taking only minutes to set up.
2. To provide spaced, color-coded, indicia-bearing marks and indicators, a stepped starting table, flippers, stakes, sticks, nets, clamps and ropes for the playing area and the players.
3. To provide an easily scored, easily retrieved projectile, with netting, ropes and stakes to set-off the scoring boundaries.
4. To provide components made of various materials, so that complete sets made from such varying materials, can be produced and sold at prices reflecting the labor and material costs of forming such components.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a frontal view of one of the nets, stakes, and ropes, set-up for use.

FIG. 3 is a top plan view of the starting table with a stick placed thereon, and a flipper, ready for use.

FIG. 4 is a cross-sectional view taken approximately along the line 4—4 of FIG. 3.

DETAILED DESCRIPTION OF THE INVENTION

Figures 1, 5, 6, 7:
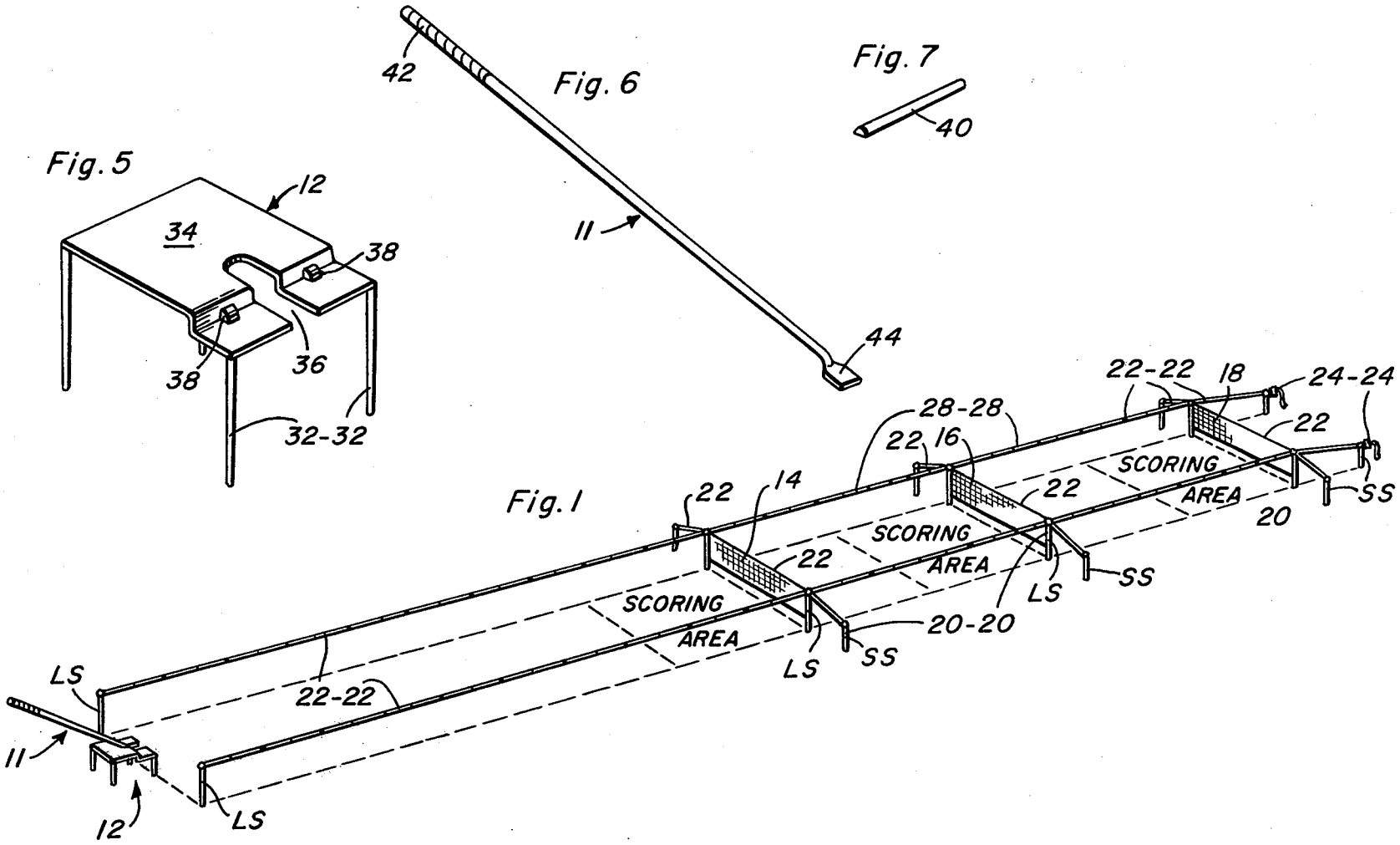
FIG. 1 is a perspective view of the playing arrangement set-up for use.
FIG. 5 is a perspective view of the starting table with stakes attached.
FIG. 6 is a perspective view of one of the flipper elements.
FIG. 7 is a perspective view of one of the flat-sided sticks.

In the set-up arrangement of FIG. 1, 10 denotes the entire game apparatus. The flipper and starting table are comprehended by reference numerals 11 and 12, respectively, and the three nets by 14, 16, and 18. 20—20 represent the various stakes (*LS* = long stakes, and *SS* = short stakes). The elevated side ropes and cross-ropes 22—22, preferably approximately ¼ inch, or approximately 0.6 centimeters, in diameter, and 40 feet (approximately 12 meters) in length for the side markers, and several feet (2 meters) for the nets. These nets are preferably made of non-stretch nylon, however less expensive materials such as clothesline ropes or other roping available at a hardware store could be substituted therefor. Approximately every foot (or every half meter) of the side ropes are marked with a colored dye, colored tape, or similar marking means. If the full 40 feet (12 meters) is too long for the usable area, the distance from the starting table 12 to the first net 14 may be shortened. Similarly, if the rope is color-coded, every half meter, the 12 meter approximate over-all length could be similarly shortened. Suitable rope clamping means 24—24 are used at the ends of the ropes remote from the starting table and the nets, to hold the ropes under the desired tension.

The nets 14, 16, and 18 are netting, preferably made of non-stretchable nylon also, however, each net could be made of simple string-type material. Each net is approximately 10 inches high by 4 feet wide (25 centimeters by 1.2 meters). The LS stakes 20—20 are approximately 1½ feet, or a half-meter, in length; and the SS stakes 20—20 are approximately 8 inches or 1/5 meter, in length, each having a loop, or ring, 26—26, at its respective uppermost portion for threading the nylon or other rope material therethrough, or, in the case of the short net stakes, to anchor the net ropes.

The dotted line marks 28—28 in front of each net may be marked on the grass in a fashion similar to football yardage and sideline marks, using lime containing material, or, a four foot length board, or a similarly elongated four foot metal or plastic rod, may be used to measure the four foot distance from each net in the direction toward the starting table, and then lay the board or rod parallel to the net four feet from the net, in the direction of the starting table. (This aspect of scoring of the game will be further described below.)

The first net 14 is positioned approximately 20 feet, or 6½ meters, from the starting table 12. The second net 16 is approximately 8 feet (2½ meters) beyond net 14; and the third net 18, another 8 feet (2½ meters) beyond net 16. Approximately four feet in front of each of the nets are the line markers 28—28, previously described. Using the foot for exemplary purposes, each "scoring" area would be the 4′ × 4′ area immediately in front of each net. Net tightening means 30—30, schematically shown on FIG. 2, or similar means, may be used to keep the nets taut between the stakes.

The starting table 12, per se, is shown in FIG. 5, and may be constructed of wood, plastic, or metal. It has four 8 inch stakes 32—32, one attached (threaded, welded, nailed, etc.) to each corner of the underside of a top plate 34 of 12. Top 34 has a U-shaped recess 36 facing the nets, in use; and, recess 36 extends approximately half way (front-to-rear) of the top 34. Further, about mid-way of recess 36, top 34 has an offset or sloping wall that extends from the upper level of 34 to the lower level of 34. Indicia marks, or projections, 38—38 are placed in and adjacent the sloping area, serve as markers, or retainers, respectively, for one of the sticks 40 (FIG. 7). Each stick 40 may be made of wood, plastic, or metal, and is approximately ½ foot, or 15 centimeters, in length, and approximately ¾ inch in diameter, except that one continuous "flat" side extends the entire length of each stick or "stix". The purpose of the flat side is to allow each stick to rest securely on top 34, spanning recess 36, and being held by projections 38—38 (or, "sighted" between marks 38—38) ready for being projected by flipper 11. The various flippers 11 and sticks 40 may be color-coded, in pairs, or each and every one may be distinctively colored. The handle portion 42—42 of each flipper 11 may be covered with a plastic or rubber handgrip. The bottom portion of each flipper 11 is made thinner, flat, and extended in side-to-side dimensions, as at 44—44, to fit within recess 36 and under a given stick 40.

The rules and scoring for my "Flipper Stix" game are as follows:

Having set-up the playing area as described and illustrated above, a typical game between two players would proceed as follows:

1. Each player has one flipper 11 and 4 stix.
2. The 4′ × 4′ area in front of net 14 scores two points; the 4′ × 4′ area in front of net 16 scores four points; and the 4′ × 4′ area in front of net 18 scores six points.
3. To score any points in the respective scoring areas, the stix must be wholly within the 4′ × 4′ area; if any part of a stix is on, or outside the 4′ × 4′ area, no points are scored.
4. Each player flips all four of his stix in sequence, during his turn.
5. If more than two players are playing, each player flips his four stix, in turn, to complete a round of play.
6. 50 points wins the game, unless more than one player is over 50 points at the end of a round, then, the player with the most points in excess of 50 points, at the end of the round, would be the winner.

As previously indicated, the various components may be made of various materials such as wood, plastic, metal, etc., and sets can be marketed at different prices, depending upon the cost of the labor and materials used to make these components.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a lawn game device, the combination of a plurality of nets, each net being parallel to its adjacent net, the spacing between each pair of nets being approximately twice the longitudinal dimension of each net, one set of rope and stake means for each net, a pair of ropes and stake means to delineate the sidelines of a playing area, each sideline rope being perpendicularly related to each net, a starting table, receiving flippers and "sticks", staked to the ground approximately parallel to the closest net, and approximately five net lengths away from said first net, scoring areas facing the starting table in front of each net, each scoring area being equal to the length of a net in both longitudinal and transverse dimensions, and tensioning means for holding the various nets and ropes in proper position, each sideline rope being threaded through a ring at the top of each stake, and each rope being color-coded at frequent intervals to measure the location of the plural nets and scoring areas, each flipper and each stick being color-coded, said tensioning means including rope clamping means adjacent the ends of the sideline ropes remote from said starting table, each said flipper being elongated and has hand-grip means at one end and a flattened area adjacent the opposite end, and each stick being generally cylindrical in shape with a flat area extending over its longitudinal dimension, said starting table having an upper flat surface and an offset wall connecting said upper flat surface to a lower flat surface, a U-shaped recess extending from approximately the center of one edge to approximately the center of the table, and intersecting said offset wall, indicia means on said offset wall and adjacent areas, and one of said flat areas of said stick fitting within said area, said recess being of sufficient dimension to receive the flattened area of a flipper, and stake means secured to the bottom of the table to fix the position of the table with respect to said nets.

2. In a game device, a table from which a stick may be projected comprising a generally horizontally disposed plate, a recess formed in an edge portion of said plate and extending no more than half-way across the plate, positioning means on said plate adjacent opposite edges of the recess for positioning a stick in bridging relation to the recess when the ends of the stick are engaged with the positioning means to enable a flipper to be disposed into the recess inwardly of the stick to project the stick away from the table by swinging the flipper upwardly and outwardly of the table, a stick, said stick being in the form of an elongated cylindrical rod having a continuous flat peripheral area extending from end to end thereof along one side for positioning on the plate without rolling, said positioning means on the plate including upstanding projections positioned for closely receiving the stick therebetween, said projections being equally apaced from the opposed edges of the recess whereby the center of the stick will be substantially alined with the mid-portion of the recess, said recess being of substantially U-shaped configuration and extending inwardly substantially beyond the projections, said projections being disposed substantially intermediate the length of the legs of the U-shaped recess, a flipper in the form of an elongated rod having a hand-grip on one end thereof, a flattened end portion on the end of the flipper remote from the hand-grip with the flattened end received in the recess and having a transverse dimension less than the transverse dimension of the recess and being guided by the recess when moved from the inner end of the recess to the end thereof communicating with the peripheral edge of the table to enable the flattened end of the flipper to be positioned vertically downwardly into the recess inwardly of the stick for propelling the stick away from the table when the flattened end of the flipper is moved rapidly forwardly and upwardly.

3. In a game device, a table from which a stick may be projected comprising a generally horizontally disposed plate, a recess formed in an edge portion of said plate, positioning means on said plate adjacent opposite edges of the recess for positioning a stick in bridging relation to the recess when the ends of the stick are engaged with the positioning means to enable a flipper to be disposed into the recess inwardly of the stick to project the stick away from the table by swinging the flipper upwardly and outwardly of the table, a stick, said stick being in the form of an elongated cylindrical rod having a continuous flat peripheral area extending from end to end thereof along one side for positioning on the plate without rolling, said positioning means on the plate including upstanding projections positioned for closely receiving the stick therebetween, said projections being equally spaced from the opposed edges of the recess whereby the center of the stick will be substantially alined with the mid-portion of the recess, said recess being of substantially U-shaped configuration and extending inwardly substantially beyond the projections, said projections being disposed substantially intermediate the length of the legs of the U-shaped recess, a flipper in the form of an elongated rod having a hand-grip on one end thereof, a flattened end portion on the end of the flipper remote from the hand-grip with the flattened end received in the recess and having a transverse dimension less than the transverse dimension of the recess and being guided by the recess when moved from the inner end of the recess to the end thereof communicating with the peripheral edge of the table to enable the flattened end of the flipper to be positioned vertically downwardly into the recess inwardly of the stick for propelling the stick away from the table when the flattened end of the flipper is moved rapidly forwardly and upwardly, said plate includes a vertically offset portion intermediate the length of the recess with the portion of the plate defining the peripheral edge of the table having the recess communicating therewith being lower than the remainder of the plate, said positioning means being disposed in the juncture between the lower portion of the plate and the offset portion thereof to facilitate positioning of the sticks intermediate the length of the recess.

4. The structure as defined in claim 3 together with a target area disposed in alined relation to the edge of the table having the recess therein, said target area being delineated by a pair of longitudinally extending ropes disposed in laterally spaced relation a distance substantially greater than the width of the table, a plurality of transverse nets extending between the side ropes and disposed in longitudinally spaced relation to provide means for determining the distance that a stick is propelled from the table.

* * * * *